US009993047B1

(12) United States Patent
Patterson et al.

(10) Patent No.: US 9,993,047 B1
(45) Date of Patent: Jun. 12, 2018

(54) BUTTON COVER AND METHOD OF USE

(71) Applicant: Jessica M. Patterson, Reno, NV (US)

(72) Inventors: Jessica M. Patterson, Reno, NV (US); Marcus Willi Karl Gerhard Bosch, Belding, MI (US)

( * ) Notice: Subject to any disclaimer, the term of this patent is extended or adjusted under 35 U.S.C. 154(b) by 0 days. days.

(21) Appl. No.: 15/819,819

(22) Filed: Nov. 21, 2017

Related U.S. Application Data

(60) Provisional application No. 62/434,001, filed on Dec. 14, 2016.

(51) Int. Cl.
*A44B 1/14* (2006.01)

(52) U.S. Cl.
CPC ..... *A44B 1/14* (2013.01)

(58) Field of Classification Search
CPC ..... Y10T 24/367; Y10T 24/3672; A44B 1/14
See application file for complete search history.

(56) References Cited

U.S. PATENT DOCUMENTS

| | | | | |
|---|---|---|---|---|
| 1,520,395 | A * | 12/1924 | Becker | A44C 11/00 24/113 MP |
| 2,577,723 | A | 12/1951 | Groh | |
| 2,776,434 | A * | 1/1957 | Ellestad | A44B 1/14 2/123 |
| 2,850,779 | A * | 9/1958 | Dobro | A44B 1/14 40/315 |
| 2,994,980 | A * | 8/1961 | Theriot | A44B 1/14 40/315 |
| 3,353,231 | A | 11/1967 | Levine | |
| 3,934,313 | A | 1/1976 | Hocq | |
| 8,726,469 | B1 * | 5/2014 | Delaneau | A44B 1/04 24/113 MP |
| 9,198,480 | B1 | 12/2015 | Junge | |
| 9,370,213 | B1 | 6/2016 | Dighton et al. | |
| 2008/0313864 | A1 | 12/2008 | Suter | |

FOREIGN PATENT DOCUMENTS

| | | |
|---|---|---|
| CA | 2433655 | 11/2004 |
| DE | 4317219 | 12/1993 |
| DE | 102010019451 | 11/2011 |
| EP | 1586249 | 10/2005 |
| JP | H0678808 | 3/1994 |
| KR | 20080097726 | 11/2008 |
| KR | 101508713 | 4/2015 |

OTHER PUBLICATIONS

International Search Report and Written Opinion of The International Searching Authority for International Application PCT/US17/66189, dated Jan. 29, 2018.

* cited by examiner

*Primary Examiner* — Robert John Sandy
(74) *Attorney, Agent, or Firm* — Holland & Hart LLP

(57) ABSTRACT

A button cover for use in covering a button to reduce or eliminate damaging of adjacent clothing such as pants, shorts, etc. Some embodiments provide a relatively thin disk shaped cover having a resilient wire button clip extending from the back side of the disk shaped cover. The button clip provides a button mounting channel formed by two opposed resilient arms in the clip, with the two opposed arms interconnected by an intermediate section of wire secured to, or formed within, the body of the disk-shaped cover. The cross-section of the button clip from its intermediate, interconnecting section through to its opposed resilient arms can be U-shaped or otherwise shaped to orient the coplanar opposed arms with the backside of the body of the disk-shaped cover.

20 Claims, 13 Drawing Sheets

BUTTON COVER AND METHOD OF USE

CROSS-REFERENCE TO RELATED APPLICATIONS

This application claims priority to the applicant's prior provisional patent application, titled "A plastic and metal clip to protect tee shirts while wearing jeans," Ser. No. 62/434,001, filed, Dec. 14, 2016, which application is incorporated by reference. In the event of any inconsistency, however, between such provisional application and this non-provisional application, this non-provisional application shall govern

FIELD OF THE DISCLOSURE

This application is directed to button covers, particularly protective button covers for covering buttons on pants (especially jeans), shorts, and the like and protecting adjacent or abutting clothing from button damage.

BACKGROUND OF SOME ASPECTS OF THE DISCLOSURE

Buttons on pants (especially jeans), shorts, and the like have long presented a significant problem for adjacent clothing, particularly tight adjacent clothing such as a tight tee shirt for example. The outwardly extending button often rubs against the tight adjacent clothing as the person wearing the clothing (especially jeans) moves, and resulting rubbing and friction between the button and the adjacent clothing moving with respect to the button can cause the adjacent clothing to become worn and even rip open at the clothing location adjacent the button.

Prior art devices have been developed to try to solve some of these types of problems. One approach consists of a relatively wide, generally rectangular clip with one clip arm section mountable to abut the inside upper edge of the pants (e.g., jeans) and the other, rectangular clip arm covering the button extending from the top of the pants. This rectangular design is bulky, causes a significant unsightly bulge in the adjacent clothing abutting and surrounding the clip, can cause a good amount of friction and wear between the bulky clip and adjacent clothing, and makes irritating or uncomfortable contact with the users skin via the rigid clip arm section abutting the upper inside edge of the pants.

Another prior art design provides a rounded metal cap with a slotted metal button mounting bracket that has curled upper lip rotatably mounted within a mounting slot cut in the rear edge of the metal cap. The button mounting bracket is a relatively rigid and non-resilient plate that is designed to fit one size of button (e.g., a ⅝ inch wide button in one embodiment) and not only cannot sufficiently flex to accommodate wider button structure but also does not firmly clasp to button structures that are narrower than the relatively wide and fixed slot in the bracket. In addition, the metal cap is also relatively bulky and thick throughout the width of the cap and causes an unsightly, edgy bulge in abutting clothing as well. Also, because the cap is rotatable with respect to the mounting bracket, the cap can rotate at unwanted times to expose both the underlying button and mounting bracket, exacerbating the problem of adjacent clothing contact with these structures.

Another prior art button cover is for making the buttons of coats more decorative, not for covering buttons under adjacent clothing. It too provides a relatively bulky and thick metal cover with thick outer edges, raised indicia extending from the upper side of the cover, and a relatively large metal mounting clip rotatably mounted to a curled lip extending from the interior edge of the cover. The mounting clip consists of a bent wire having two arms extending somewhat transversely from a coplanar central section mounted in the curled lip. The clip arms are relatively widely spaced apart to embrace a particularly wide type of coat button, and they each have pointed ends that terminate adjacent to the outer edge of the cap. This button cover would not be suitable for purposed of reducing the visibility of the cap under abutting clothing or for sufficiently reducing the likelihood of damage to abutting clothing. The prominent, outwardly extending indicia, and the exposed point mounting clip arms, would both cause undue friction and damage to abutting clothing such as a tight tee shirt for example.

BRIEF SUMMARY OF SOME ASPECTS OF THE DISCLOSURE

The applicant believes she has discovered at least some of the issues with the prior art noted in the Backgrounds section supra. She has therefore developed an improved button cover for pants, shorts, and the like.

In some embodiments, the button cover provides a cover that is thinner. Some such embodiments can therefore provide one or more among being less obtrusive when worn under other clothing and causing less friction with adjacent or abutting clothing.

In some embodiments, the button cover includes a fixed, optionally resilient, clip securable or secured within or to a body section of the button cover. The fixed clip can be formed of one or more bent wires, and in some one wire embodiments, the single wire can be pre-bent to provide a base mounting section securable within or to the body section and a opposed clip arms extending from the based mounting section. Some instances can provide curled clip ends that prevent pointed or sharp edged structure from being exposed to adjacent clothing or a person's skin when handling the button cover, such as for example when installing or removing the button cover.

In some instances, the opposed clip arms are resilient and have portions that are parallel to each other and/or otherwise relatively close together. Some instances of this feature can allow the clip arms to resiliently and firmly embrace button structure on the underside of a button, which may be a rigid portion of a button or thread securing the button to clothing, such pants for example.

Some applications provide an integral button cover with the fixed clip molded into body section. The body section can also provide the button covering structure, and in some embodiments, the body section is disk shaped with a generally rounded outer face surrounded by a relatively thin circular peripheral edge. The peripheral edge can also optionally be rounded so that the portions of the cover that may contact abutting clothing, such as a tight tee shirt for example, will cause less friction as the clothing rubs the cover and/or reduce or eliminate the possibility of ripping the clothing.

The body section can include a depression or somewhat concave shaped side opposite the outer face. In some applications, this feature can allow the overall button cover to provide a narrowed or thinner profile when mounted to a button.

Some instances can consist of only a button wire or other clasp or button mounting bracket molded within, or otherwise fixedly secured to, a button cover cap.

Some embodiments can be lightweight and/or relatively thin and thus easy to package, transport, and store.

There are other novel features and aspects of this specification. They will become apparent as the specification proceeds. In this regard, the scope of the invention is to be determined by the claims as issued and not by reason of whether an aspect or feature has or has not been addressed in the Background or this Summary section of this specification.

BRIEF DESCRIPTION OF THE DRAWINGS

The applicant's preferred and other embodiments are described in association with the accompanying Figures in which.

DETAILED DESCRIPTION OF SOME EMBODIMENTS

The prior Brief Summary and the following description provide examples that are not limiting of the scope of this specification. One skilled in the art would recognize that changes can be made in the function and arrangement of elements discussed without departing from the spirit and scope of the disclosure. Various embodiments can omit, substitute, add, or mix and match various procedures or components as desired. For example, features disclosed with respect to certain embodiments can be combined in or with other embodiments as well as features of other embodiments.

Figure 1:
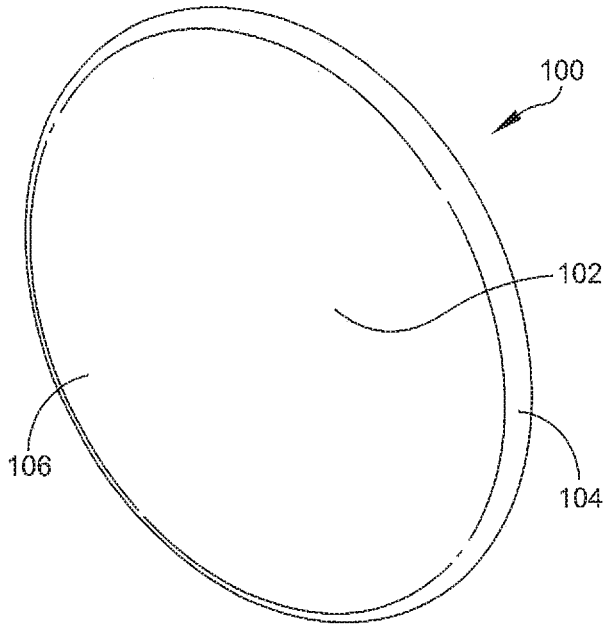
FIG. 1 is perspective view of the front face of one embodiment of the present button cover.
Figure 2:
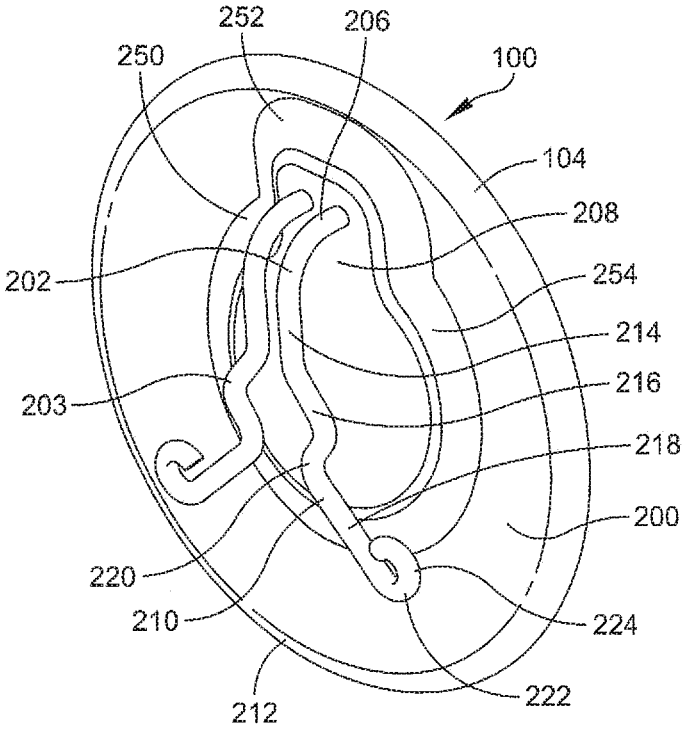
FIG. 2 is a perspective view of the back side of the button cover of FIG. 1.

Referring now to FIG. 1, one embodiment of a protective button cover, generally 100, has a generally circular, rigid, disk-shaped body section 102 with a thin rounded circular outer edge 104 surrounding the circular front face 106 of the button cover 100. With reference to FIG. 2, the button cover 100 has a back side 200 with opposed, resilient button mounting clip arms 202, 203 extending from body section 102 of the button cover 100. Each mounting clip arm, e.g., 202, has a bent arm section 206 (*i*) extending from body section 102 transverse to a central planar portion 208 of the back side 200 of the body section 102 and (ii) bending to yield a central laterally extending arm section 210 extending toward the lower edge 212 of the back side 200. The laterally extending arm section 210 of the mounting clip arm 202 has a linearly extending section 214, a V-shaped button-gripping section 216 extending from the linearly extending section 214, and a guiding arm 218 extending perpendicularly from the lower end 220 of the V-shaped button-gripping section 216. The lower end 222 of the guiding arm 218 is curved 224 and bent back approximately 150 to 170 degrees to provide a blunt, rounded end 222 spaced radially inwardly from the outer edge 104.

Figure 3:
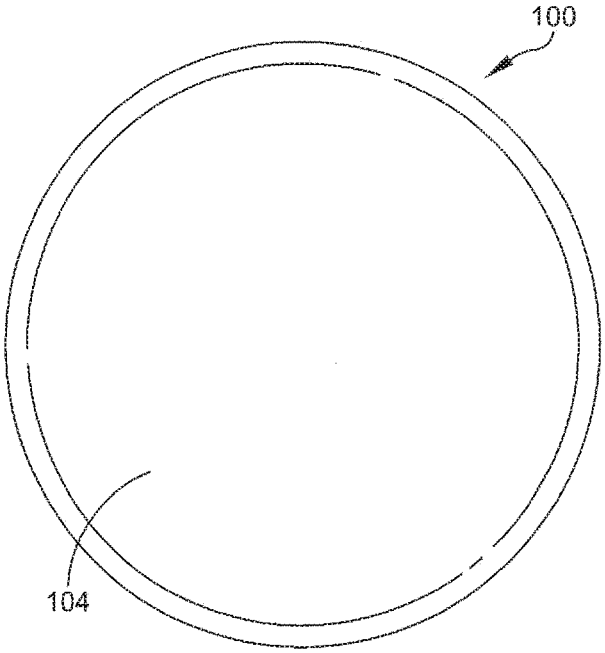
FIG. 3 is a plan view of the front face of the button cover of FIG. 1.
Figure 4:
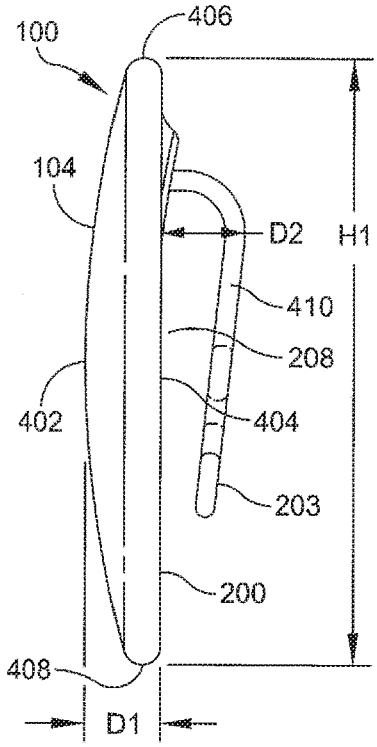
FIG. 4 is an elevational side view of button cover of FIG. 1.

With reference now to FIGS. 3 and 4, the front face 104 of the button cover 100 provides a shallowly or softly rounded front face periphery 400. As a result, the depth D1 of the body section 102 from the peak 402 of the front face periphery 400 to the laterally opposing section 404 of the back side 200 is approximately 4-8 times smaller than the height H1 of the body section as measured from its top edge 406 to its back edge 408. In one embodiment, the depth D1 is 0.22 inches, and the height H1 or diameter is 1.75 inches.

Referring now to FIG. 4, the laterally extending arm sections 410, 210 (210 not shown in FIG. 4) of the mounting clip arms, e.g., 203, are coplanar and extend at angle, for example a 2-10 degree angle, or in the depicted embodiment of FIG. 4, approximately a 5-6 degree angle, to the plane of the central planar portion 208 of the back side 200 of the body section 102. In one embodiment, the depth D2 of each mounting clip arm, e.g., 410 from its outer peak 412 to the plane of the central planar portion 208 is 0.25 inches.

Figure 5:
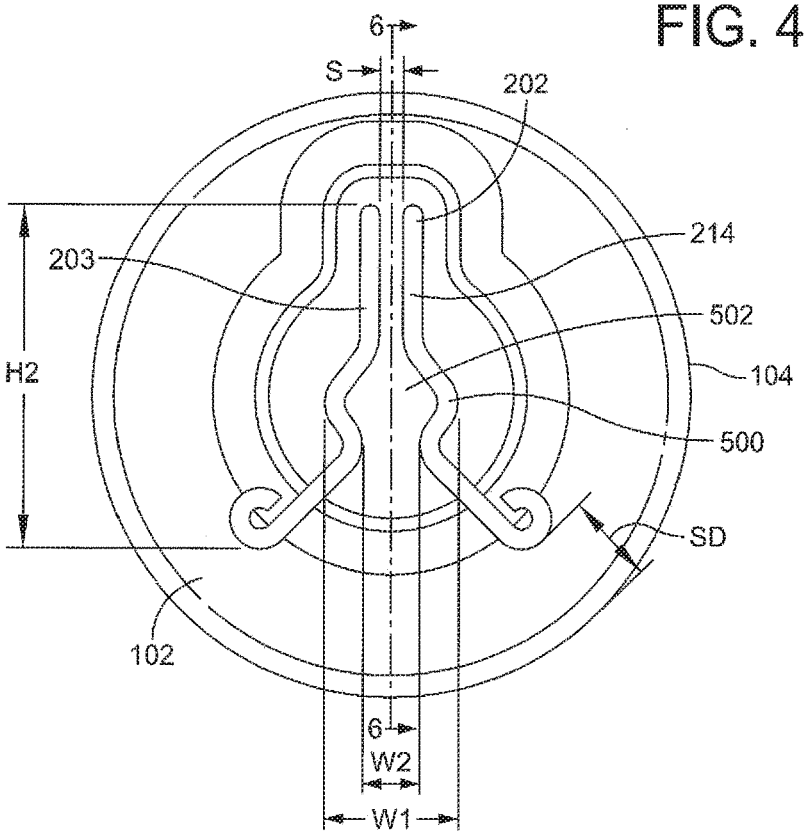
FIG. 5 is view of the back side of the button cover of FIG. 1.

With reference now to FIG. 5, the linearly extending sections, e.g., 214, of the opposed arms 202, 203 are parallel to each other and spaced S from each other by 0.1 inches. The opposed V-shaped button-gripping sections, e.g., 216, in the opposed arms 202, 203 have bottom ends, e.g., 500, pointing or extending toward the outer edge 104 of the body section 102. The opposed V-shaped button-gripping sections, e.g., 216, create an open-cornered generally square-shaped channel 502 between them, e.g., 216. In one embodiment: the maximum lateral width W1 (i.e., transverse to axis of the laterally extending arms sections 410, 210) of the square-shaped channel 502 is 0.375 inches; the width W2 of the open corner is 0.2 inches; the height H2 of each mounting clip arm, e.g., 203, is 1.0 inch; and the separation distance SD from the outer edge 104 of the body section 102 to the blunt, rounded end 222 is 0.3 inches.

Figure 6:
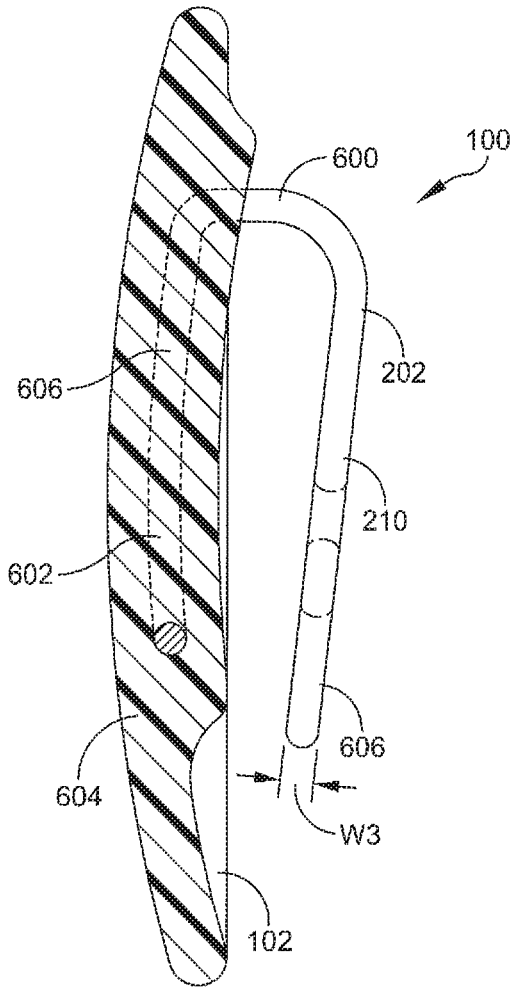
FIG. 6 is a cross-sectional view taken along section line 6-6 of FIG. 5.

With reference now to FIG. 6, each mounting clip arm, e.g., 202, has an overall U-shaped cross-section with an interconnection arm 600 intermediate the laterally extending arm sections, e.g., 210, and an opposed interior wire mounting section 602. Further, the interior wire mounting section 602, which can be secured within the body section interior 604 by over-molding the interior wire section 602 within the body section interior 604, also provides an interconnection section 602 between the opposed mounting clip arms 202, 203 (203 not shown in FIG. 6). In one embodiment, the width W3 of the one-wire mounting clip 606 is 0.06 inches.

In some embodiments, the mounting clip 606 can be made of any suitable flexible, resilient material. Exemplary such material is spring steel. If desired, the material, such as spring steel for example, may be coated to improve the appearance of the material, such as with a metallic coating in the case of spring steel for example.

In some embodiments, the body section 102 can be made of any suitable relatively rigid material after formation. Exemplary such material is thermoplastic, such as polyethylene for example.

Figure 7:
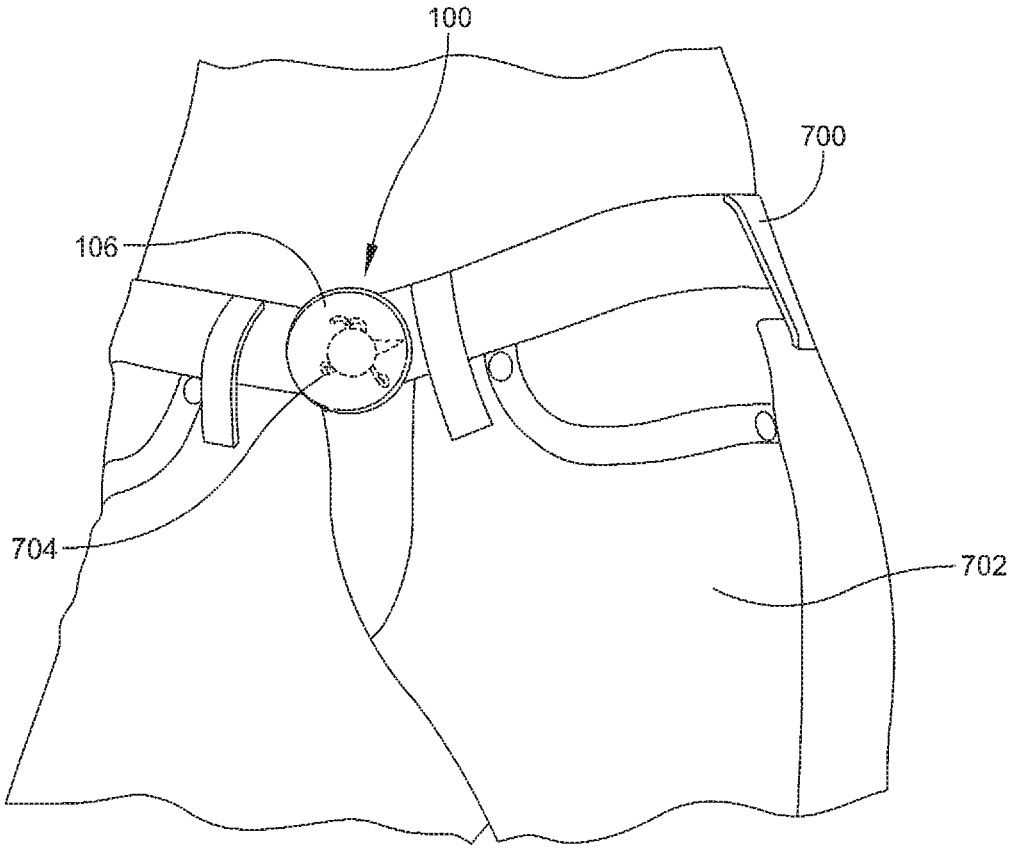
FIG. 7 is a perspective view of a button cover embodiment mounted to cover an underlying pant button at the top edge of a pair of pants being worn by a person.

The resulting button cover 100 can be one unitary piece, such as with the mounting clip 606 secured to or within the body section 102. It can also be very light, and in an embodiment with the mounting clip 606 consisting of copper and the body section consisting of polyethylene, the clip weighs only 8.2 grams, though embodiments could weigh less or more, such as up to ninety percent less and thousands of percent more. The exemplary weights and dimensions identified for the button cover 100 yield a button cover that, as shown in FIG. 7, the user generally does not feel when in place and worn by the user to cover a button (not shown in FIG. 7) for example adjacent a upper edge 700 of the user's jeans 702.

Figure 16:
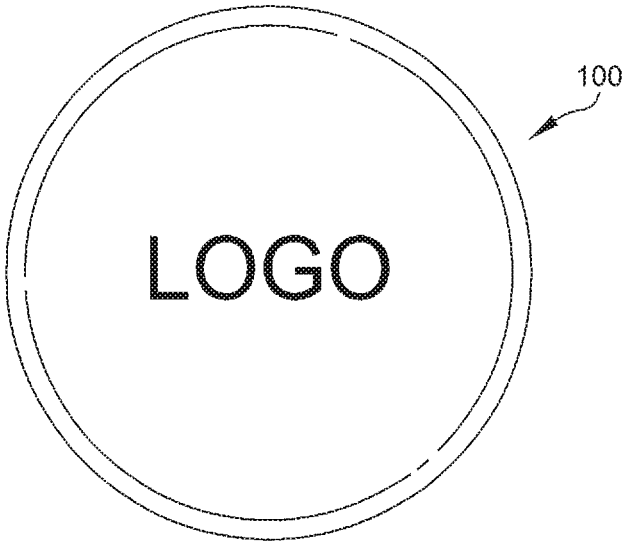
FIG. 16 is a plan view of a button cover embodiment bearing logo indicia on its front face.
Figure 17:
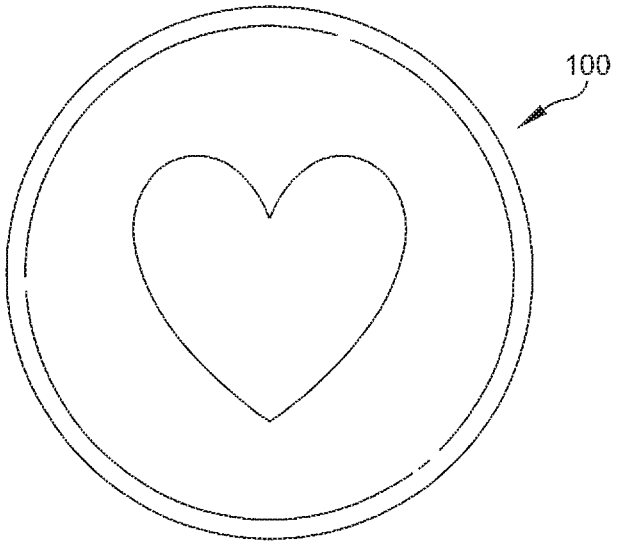
FIG. 17 is a plan view of a button cover embodiment bearing artwork indicia on its front face.

The present button cover 100 may also have indicia 704 or coloring of the body section 102, and this indicia or coloring may render the button cover more aesthetically pleasing when observable. Similarly or alternatively, the indicia 704 may include a name, trademark, logo (see FIG. 16), artwork or meaningful symbol (see FIG. 17), political affiliation, or promotional phrase, and may be printed on, formed in, or placed by adhesive label on, the outer surface of button cover 100 such as on its front face 106 as shown in FIGS. 7, 16, and 17. Such forming can occur during a molding or other suitable manufacturing process.

In some embodiments, the button cover 100 may be mounted about a button in other clothing locations, such as on a sport coat button or shirt button. One method of use of the button cover 100 can be as name display for the person wearing the button cover.

Figure 8:
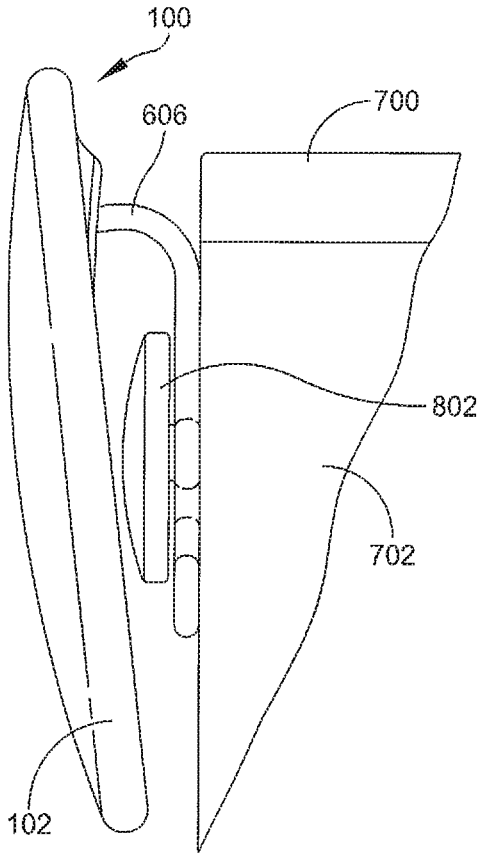
FIG. 8 is partial elevational side view of the button cover as mounted in FIG. 7.
Figure 9:
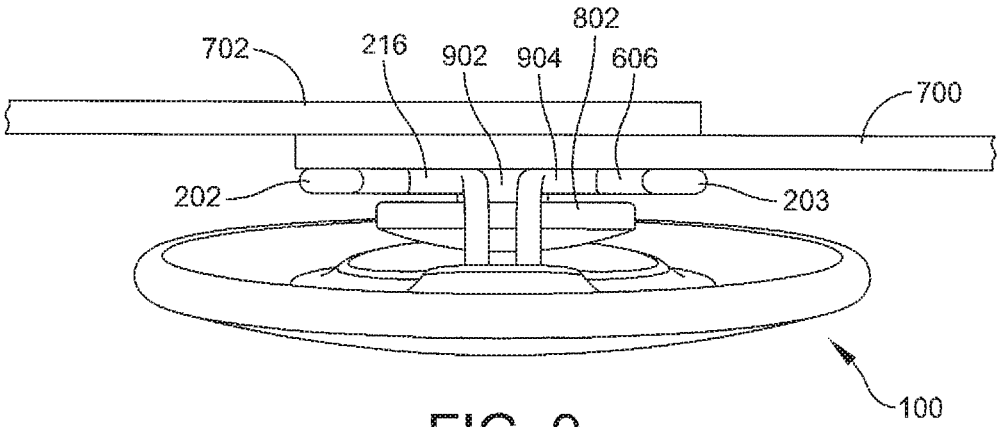
FIG. 9 is a partial plan view of the button cover as mounted in FIG. 7.

With reference to FIGS. 8 and 9, the button cover body section 102 is mounted about and spaced from the covered jean button 802 protruding from adjacent the upper edge 700 of the jeans 702. During mounting of the button cover 100 about the jean button 802, the opposed resilient arms 202, 203 can flex away from each other if needed and when slid in place about the button cover 100 resiliently return toward the resilient arms' 202, 203 predetermined shape.

In some embodiments, the button gripping sections, 216, 904 of the resilient arms 202, 203, respectively, can resiliently grip the outer periphery of a button mounting tab 902 extending laterally outwardly from the back side 804 of the button 202. This gripping function can help hold the button cover 100 in position with respect to the button 802. Further, the button cover can also be held in position with respect to the button 802 by friction between the mounting clip 606 and the opposed clothing (in this case, jeans 702) and button 802 surfaces abutting the mounting clip 606 on opposed sides of the clip 606 intermediate the opposed clothing 702 and button 802.

Figure 10:
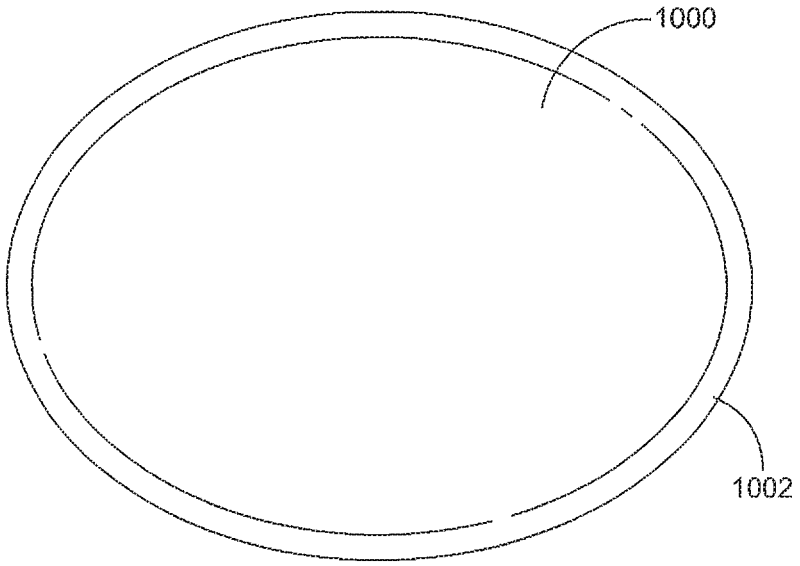
FIG. 10 is a plan view of an alternative oval-shaped button cover.
Figure 11:
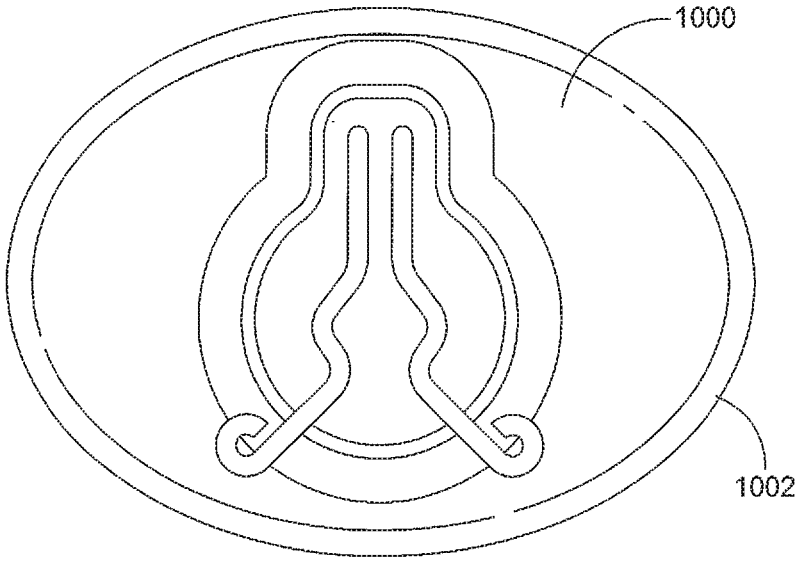
FIG. 11 is a view of the back side of the oval-shaped button cover of FIG. 10.
Figure 12:
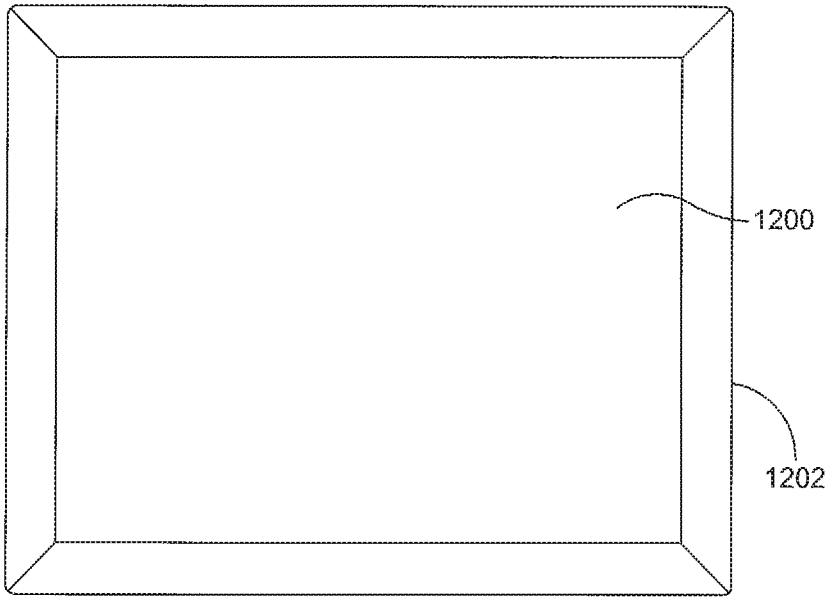
FIG. 12 is a plan view of an alternative rectangular-shaped button cover.
Figure 13:
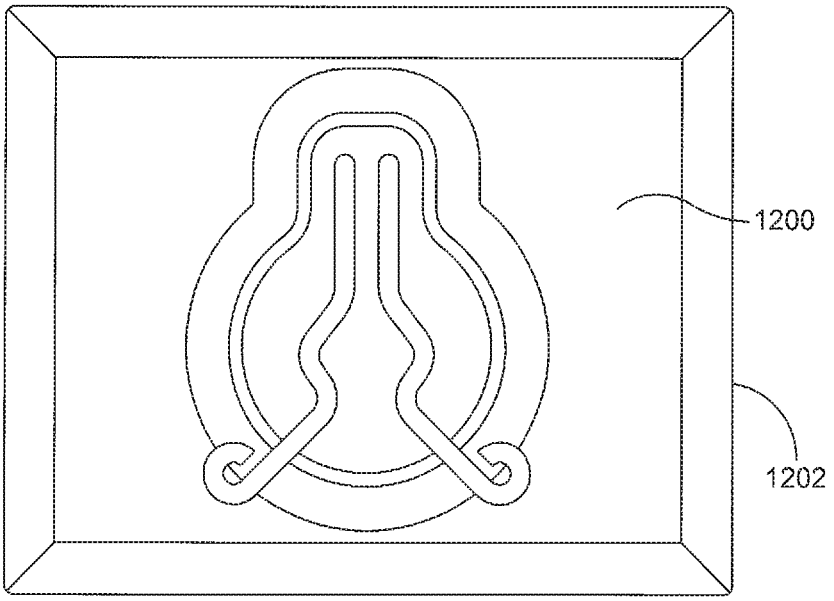
FIG. 13 is a view of the back side of the rectangular-shaped button cover of FIG. 10.
Figure 14:
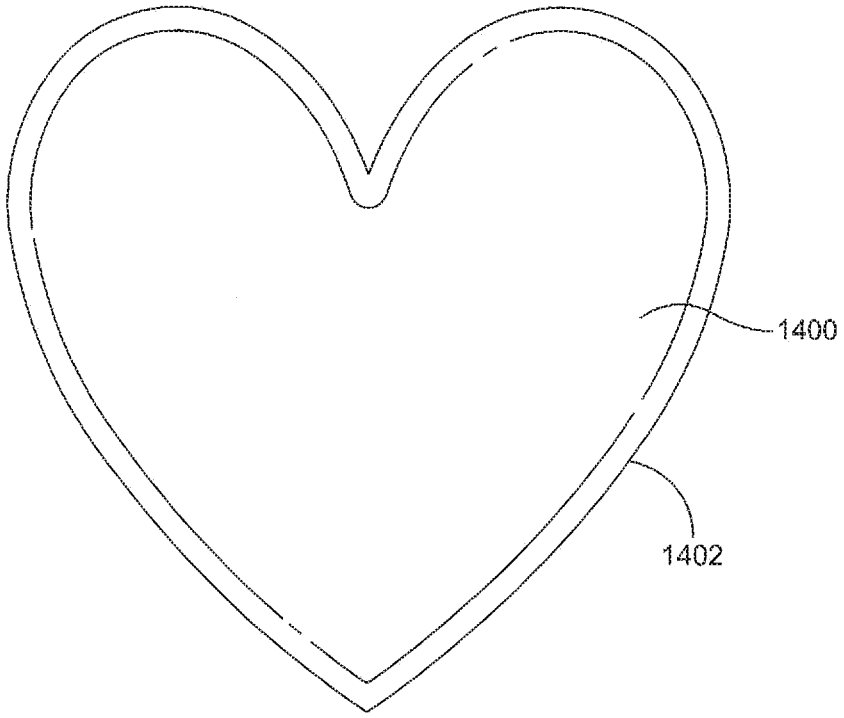
FIG. 14 is a plan view of an alternative heart-shaped button cover.
Figure 15:
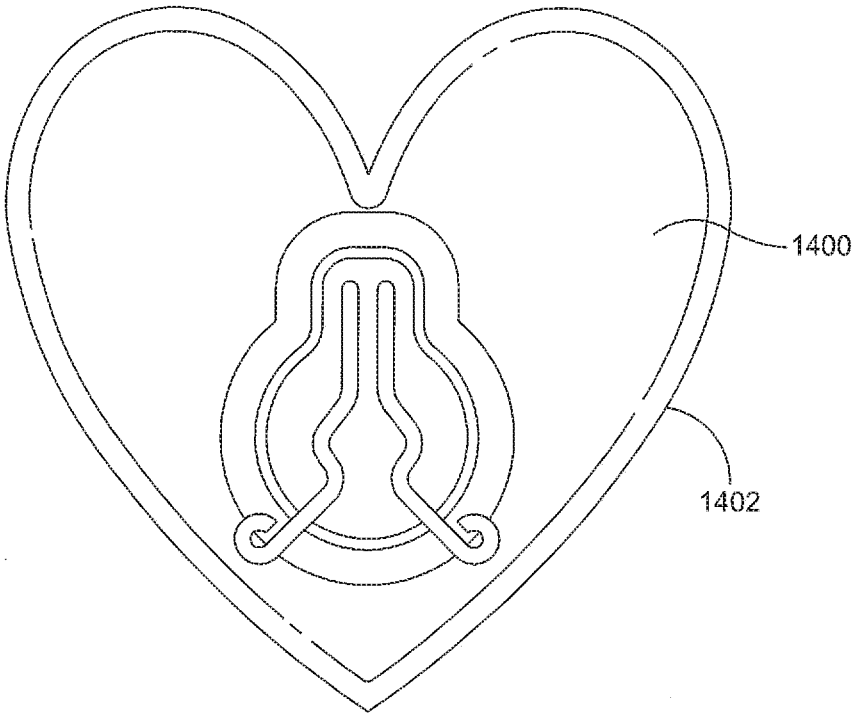
FIG. 15 is a view of the back side of the heart-shaped button cover of FIG. 10.

The body section of the button cover may have other shapes. For example, as shown in FIGS. 10 and 11, the body section 1000 may have an oval outer peripheral edge 1002. As shown in FIGS. 12 and 13, the body section 1200 may have a rectangular outer peripheral edge 1202. As shown in FIGS. 14 and 15, the body section 1400 may have a heart shaped outer peripheral edge 1402.

Figure 18:
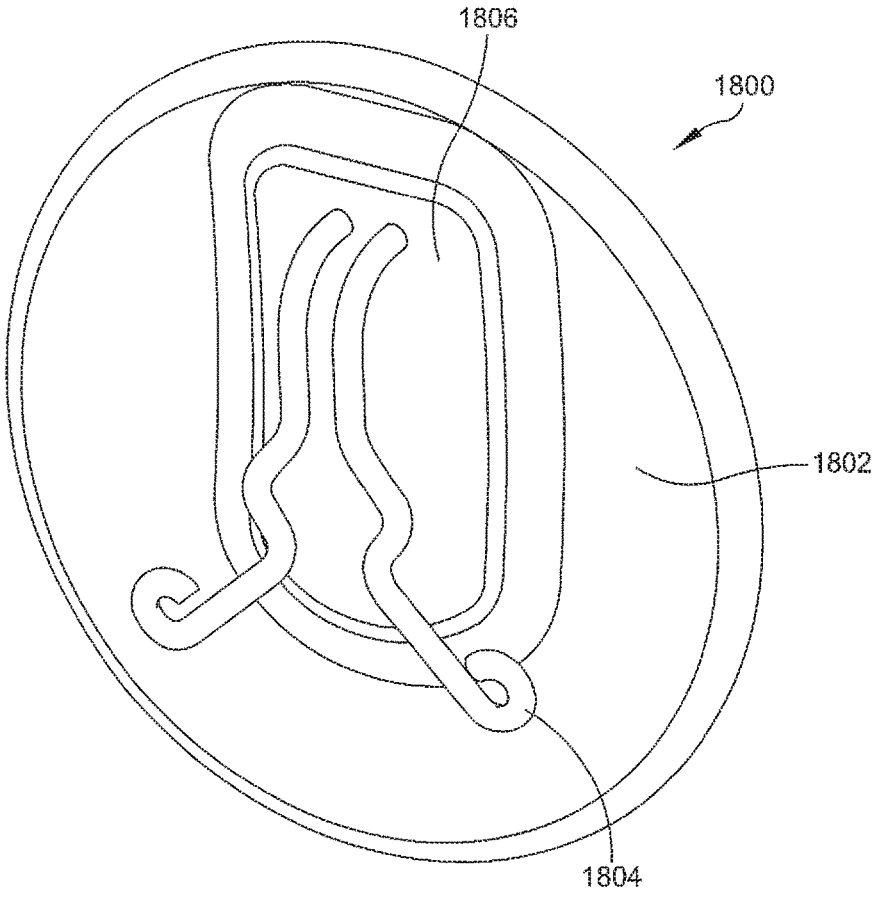
FIG. 18 is a perspective view of an alternative embodiment of a button cover.
Figure 19:
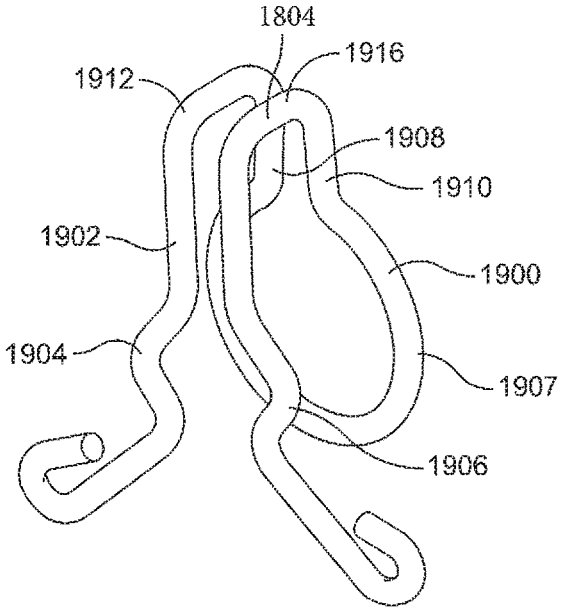
FIG. 19 is a perspective view of a pre-formed, free-standing mounting clip prior to it being over-molded into the button cover of FIG. 18 as the button cover body section is molded.
Figure 20:
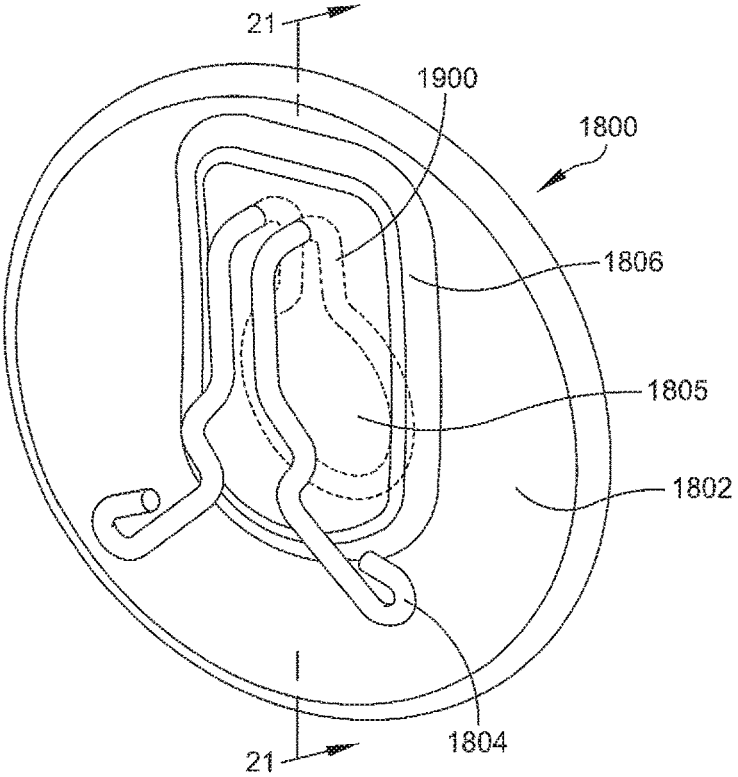
FIG. 20 is a perspective view of the button cover of FIG. 18 showing the widened circular base section (shown in phantom) of the mounting clip over-molded with the body section of button cover.
Figure 21:
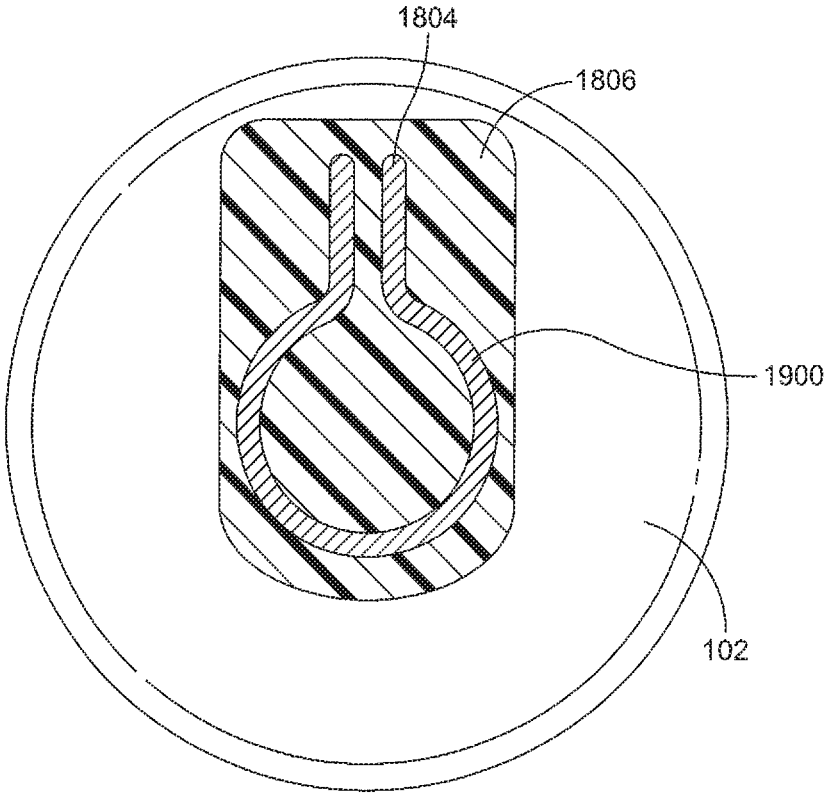
FIG. 21 is a cross-sectional view taken along section line 21-21 of FIG. 20.

With reference to FIG. 18, an alternative embodiment of a button cover, generally 1800, has a body section 1802 and a mounting clip 1804 mounted securely within a generally rectangular clip mounting cap or over-molded portion 1806 extending partially outwardly from the convex backside 1808 of the button cover 1800. As shown in FIG. 19, the unitary mounting clip 1804 has an interior mounting section 1900 extending generally parallel to coplanar opposed clip arms sections 1904, 1906 of the mounting clip 1804. The interior mounting section 1900 has a central widened circular wire base 1907 with two parallel and opposed wire base arms 1908, 1910 extending away from the circular wire base 1907 to interconnect with parallel intermediate arms 1912, 1914 transversely extending from the opposed wired base arms 1908, 1910, respectively. In turn, the opposed intermediate arms 1912, 1914 to interconnect with the opposed clip arms sections 1904, 1906 transversely extending from the opposed wired base arms 1908, 1910, respectively. As shown in FIGS. 20 and 21, the interior mounting section 1900 of the mounting clip 1804 is therefore mounted within the central area 1804 of the body section 1802 and held in position at that location 1804 by the mounting cap or over-molded portion 1806 in the body section 1802 of the button cover 1800.

The rectangular mounting cap or over-molded portion 1806 of the embodiment of FIGS. 18-21 can be easier and less costly to manufacture than the embodiment of FIG. 2 in which the latter's mounting cap or over-molded section 250 has generally rectangular section 252 extending from a generally disk-shaped section 254.

Figure 22:
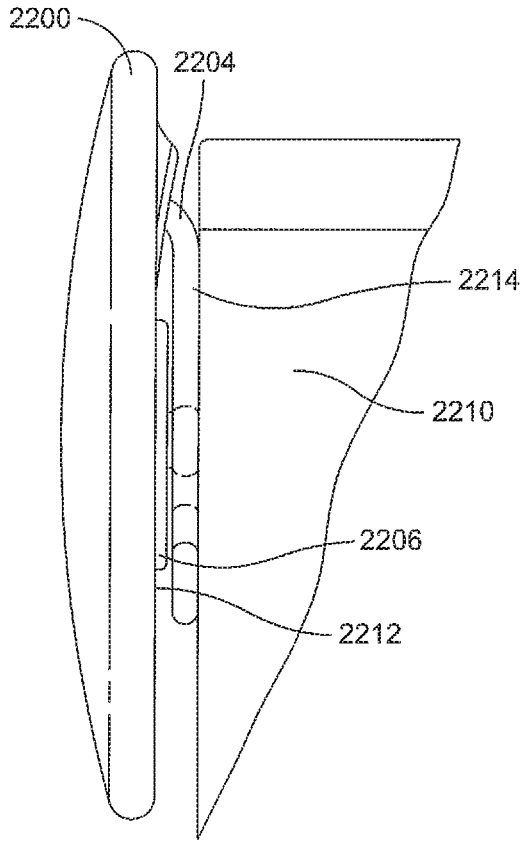
FIG. 22 is a partial side elevational view of a yet alternative embodiment of a button cover mounted about the top front button on jeans and providing a narrower or less deep profile, including when mounted on the jeans.

With reference now to FIG. 22, another embodiment of a button cover 2200 can have a mounting clip 2204 with less depth or that otherwise results in a narrower depth of the of the clip 2204 (up to 70 percent less such depth) than, as shown if FIG. 4, the depth D2 of the button cover 100. As shown in FIG. 22, narrower clip depth can provide a button cover 2200 that mounts about a jean button 2206 so that the button cover body section 2208 is much closer to the jeans 2210, including by having the jean button 2206 penetrate the convex backside 2212 of the body section 2208.

The resulting body section 2208 and mounting clip arm sections, e.g., 2214, are thus more vertical with the jean wearer stands as compared to, with reference to FIG. 8, the more tilted body section 102 of the button cover 100 having the mounting clip 606 that has more depth D2 as shown in FIG. 4. As shown in FIG. 2200, the less deep button cover 2200 can protrude less from the adjacent jean material and reduces both visibility of the button cover when worn under adjacent clothing and the level of friction with that adjacent clothing.

Figure 23:
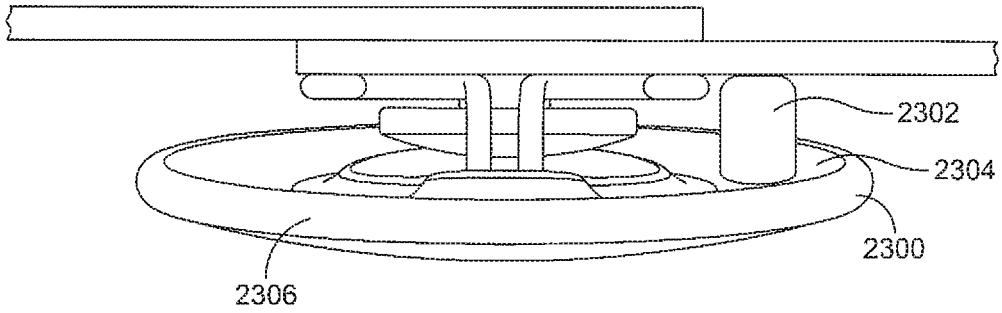
FIG. 23 is a partial plan view of another embodiment of button cover having a stabilizer protrusion or arm extending from the backside of the body section of the button cover.

Referring now to FIG. 23, an alternative embodiment of the button cover 2300 can include one or more stabilizer arms, e.g., 2302 extending transversely from the backside 2304 of the body section 2306 of the button cover 2300 to terminate in a somewhat rounded or bunt end 2308 spaced from the backside 2304. The stabilizer arm 2302 can help secure the orientation of the body section 2306 with respect to the person's jeans 2310, preventing tilting of the body section 2306 toward the jeans. In this regard, one particularly beneficial location of the stabilizer arm 2302 is on the portion of the body section that is to the left of a jean button 2312 when the button cover 2300 is mounted on the jean button 2312.

All dimensions and angles disclosed above can be varied for varying circumstances, uses, and objects. They may be varied by ranges of minus 80 percent to plus 500 percent depending on the application.

The process parameters, functions, system features, and sequence of steps described and/or illustrated herein are given by way of example only and may be varied and mixed and matched as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The foregoing detailed description has described some specific embodiments. However, the illustrative discussions above are not intended to be exhaustive or to limit the invention to the precise forms disclosed. Many modifications and variations are possible in view of the above teachings. The embodiments were chosen and described in order to explain the principles of the present systems and methods and their practical applications, to thereby enable others skilled in the art to best utilize the present systems, their components, and methods and various embodiments with various modifications as may be suited to the particular use contemplated.

Unless otherwise noted, the terms "a" or "an," as used in the specification and claims, are to be construed as meaning "at least one of" In addition, for ease of use, the words "including" and "having," as used in the specification and claims, are interchangeable with and have the same meaning as the word "comprising." In addition, the term "based on" as used in the specification and the claims is to be construed as meaning "based at least upon." Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C).

Unless otherwise indicated, all numbers or expressions, such as those expressing dimensions, physical characteristics, and the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

All disclosed ranges are to be understood to encompass and provide support for claims that recite any and all subranges or any and all individual values subsumed by each range. For example, a range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

All disclosed numerical values are to be understood as being variable from within minus 90% to plus 100% and thus provide support for claims that recite such values or any and all ranges or subranges that can be formed by such values. For example, a stated numerical value of 8 should be understood to be capable of varying from 0.8 (minus 90%) to 16 (plus 100%). The subject matter recited in the claims is not coextensive with and should not be interpreted to be coextensive with any embodiment, feature, or combination of features described or illustrated in this document. This is true even if only a single embodiment of the feature or combination of features is illustrated and described in this document.

What we claim is:

1. A button cover comprising in combination:

a button cover base;

a resilient button mounting wire having a central mounting section intermediate opposed, spaced-apart bent arms extending from the central mounting section; each bent arm having a resilient button clasp arced section intermediate a curled wire end and a bent section bending transverse to the button clasp arced section; the central mounting section being mounted within the button cover base whereby the opposed curled wire ends may resiliently spread apart to allow a button component to penetrate the button clasp arced section, wherein the button cover base has a front face opposed to a mounting wire penetrating face and the clasp arced section of each bent arm and the opposed curled wire ends are parallel to the mounting wire penetrating face.

2. The button cover of claim 1 wherein the central mounting section of the button mounting wire is entirely surrounded and abutted by button cover base material, whereby the central mounting section is secured within the button cover base.

3. The button cover of claim 2 wherein, in each bent arm, the curled wire end is spaced from the button clasp arced section by a spacing section extending at an angle away from the opposed bent arm.

4. The button cover of claim 3 wherein the button cover base and bent arms cooperatively provide a resilient button cover clasp, whereby the button cover may be mounted about, clasp, and cover a button on clothing.

5. The button cover of claim 1 wherein the button cover base comprises plastic.

6. The button cover of claim 5 wherein, in each bent arm, the curled wire end is spaced from the button clasp arced section by a spacing section extending at an angle away from the opposed bent arm.

7. The button cover of claim 6 wherein the button cover base and bent arms cooperatively provide a resilient button cover clasp, whereby the button cover may be mounted about, clasp, and cover a button on clothing.

8. The button cover of claim 1 wherein the button cover base consists essentially of plastic.

9. The button cover of claim 8 wherein, in each bent arm, the curled wire end is spaced from the button clasp arced section by a spacing section extending at an angle away from the opposed bent arm.

10. The button cover of claim 9 wherein the button cover base and bent arms cooperatively provide a resilient button cover clasp, whereby the button cover may be mounted about, clasp, and cover a button on clothing.

11. The button cover of claim 1 wherein, in each bent arm, the curled wire end is spaced from the button clasp arced section by a spacing section extending at an angle away from the opposed bent arm.

12. The button cover of claim 11 wherein the button cover base and bent arms cooperatively provide a resilient button cover clasp, whereby the button cover may be mounted about, clasp, and cover a button on clothing.

13. The button cover of claim 11 wherein the button cover base is integral, one-piece, and consists essentially of plastic.

14. The button cover of claim 1 wherein the button cover base and bent arms cooperatively provide a resilient button cover clasp, whereby the button cover may be mounted about, clasp, and cover a button on clothing.

15. The button cover of claim 2 wherein the button cover base and bent arms cooperatively provide a resilient button cover clasp, whereby the button cover may be mounted about, clasp, and cover a button on clothing.

16. The button cover of claim 5 wherein the button cover base and bent arms cooperatively provide a resilient button cover clasp, whereby the button cover may be mounted about, clasp, and cover a button on clothing.

17. The button cover of claim 8 wherein the button cover base and bent arms cooperatively provide a resilient button cover clasp, whereby the button cover may be mounted about, clasp, and cover a button on clothing.

18. A molded button cover for covering a button on clothing, comprising in combination:

an integral, one-piece button cover element have a button covering portion surrounding a wire mounting section;

a resilient U-shaped button clasp wire wherein a first arm of the button clasp wire and a second arm of the button clasp wire provide opposed resilient ends of the button clasp wire and a bent wire section intermediate the opposed resilient ends of the button clasp wire penetrates the wire mounting section of the button cover element, with the wire mounting section abutting the entire periphery of the bent wire section, whereby the button clasp wire is molded and thereby secured within the wire mounting section of the integral, one-piece button cover element.

19. The button cover of claim 18 wherein button covering portion is disk-shaped with a circular outer peripheral edge encircling the button clasp.

20. The button cover of claim 19 wherein the integral, one-piece button cover element consists essentially of plastic.

* * * * *